US006198466B1

(12) United States Patent
Morich et al.

(10) Patent No.: US 6,198,466 B1
(45) Date of Patent: Mar. 6, 2001

(54) MULTIFUNCTIONAL DIGITAL INDICATOR

(75) Inventors: Robert S. Morich, Crystal Lake; Victor J. Szeplaki, Naperville, both of IL (US)

(73) Assignee: L3 Communications Electrodynamics, Inc., Rolling Meadows, IL (US)

( * ) Notice: Subject to any disclaimer, the term of this patent is extended or adjusted under 35 U.S.C. 154(b) by 0 days.

(21) Appl. No.: 09/405,187

(22) Filed: Sep. 24, 1999

(51) Int. Cl.[7] ..... G09G 3/36

(52) U.S. Cl. ..... 345/95; 345/34; 345/38; 349/35

(58) Field of Search ..... 345/34, 35, 38, 345/87, 97, 95, 94, 90; 349/35

(56) References Cited

U.S. PATENT DOCUMENTS 4,060,801 * 11/1977 Stein et al. ..... 345/38
4,191,955 * 3/1980 Robert ..... 345/38
5,371,511 * 12/1994 Atherton, Jr. et al. ..... 345/38
5,699,074 * 12/1997 Sutherland et al. ..... 345/90
5,861,861 * 1/1999 Nolan et al. ..... 345/87
5,933,203 * 8/1999 Wu et al. ..... 349/35

* cited by examiner

*Primary Examiner*—Dennis-Doon Chow
*Assistant Examiner*—Amr Awad
(74) *Attorney, Agent, or Firm*—Jones, Day, Reavis & Pogue

(57) ABSTRACT

A nonmechanical fully electronic multifunctional digital indicator useful for providing elapsed time indications or as event counters is disclosed. The event counter uses a ChLCD-type matrix array and requires unique steps to properly erase and place new information on the display without inadvertently changing the status of individual array elements.

20 Claims, 5 Drawing Sheets

| | ROW 1 PIN 2 | ROW 2 PIN 19 | ROW 3 PIN 18 | ROW 4 PIN 17 | ROW 5 PIN 7 | ROW 6 PIN 8 | ROW 7 PIN 12 | ROW 8 PIN 9 |
|---|---|---|---|---|---|---|---|---|
| COLUMN 1 PIN 1 | B1 | A1 | B2 | A2 | B3 | A3 | B4 | A4 |
| COLUMN 2 PIN 10 | G1 | F1 | G2 | F2 | G3 | F3 | G4 | F4 |
| COLUMN 3 PIN 11 | C1 | E1 | C2 | E2 | C3 | E3 | C4 | E4 |
| COLUMN 4 PIN 20 | H1 | D1 | H2 | D2 | H3 | D3 | H4 | D4 |

| | ROW 1 PIN 2 | ROW 2 PIN 3 | ROW 3 PIN 4 | ROW 4 PIN 18 | ROW 5 PIN 17 | ROW 6 PIN 16 | ROW 7 PIN 15 | ROW 8 PIN 14 | ROW 9 PIN 13 | ROW 10 PIN 7 | ROW 11 PIN 8 | ROW 12 PIN 9 | ROW 13 PIN 6 |
|---|---|---|---|---|---|---|---|---|---|---|---|---|---|
| COLUMN 1 PIN 10 | A1 | • | F1 | B2 | A2 | F2 | B3 | A3 | F3 | B4 | • | A4 | BKGD |
| COLUMN 2 PIN 1 | B1 | g1a | G1 | • | b2a | G2 | G3 | b3a | • | G4 | b4a | F4 | BKGD |
| COLUMN 3 PINS 11 & 20 | C1 | g1b | E1 | C2 | b2b | • | • | b3b | E3 | C4 | b4b | E4 | BKGD |
| COLUMN 4 PIN 12 | • | D1 | dp | D2 | • | E2 | C3 | • | D3 | • | D4 | • | BKGD |
FIG. 5B
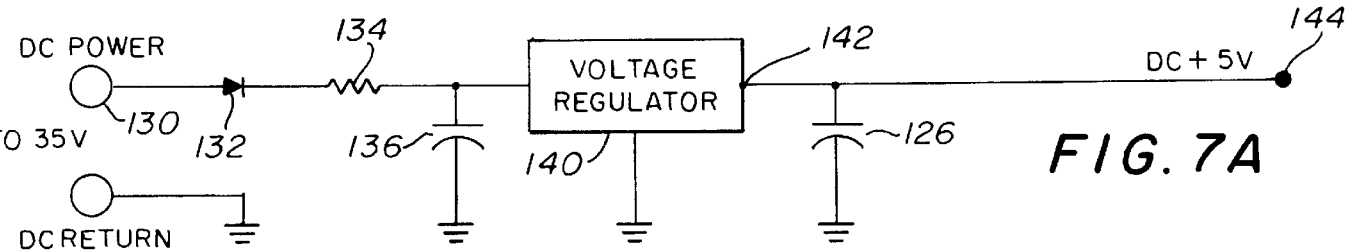
FIG. 7A
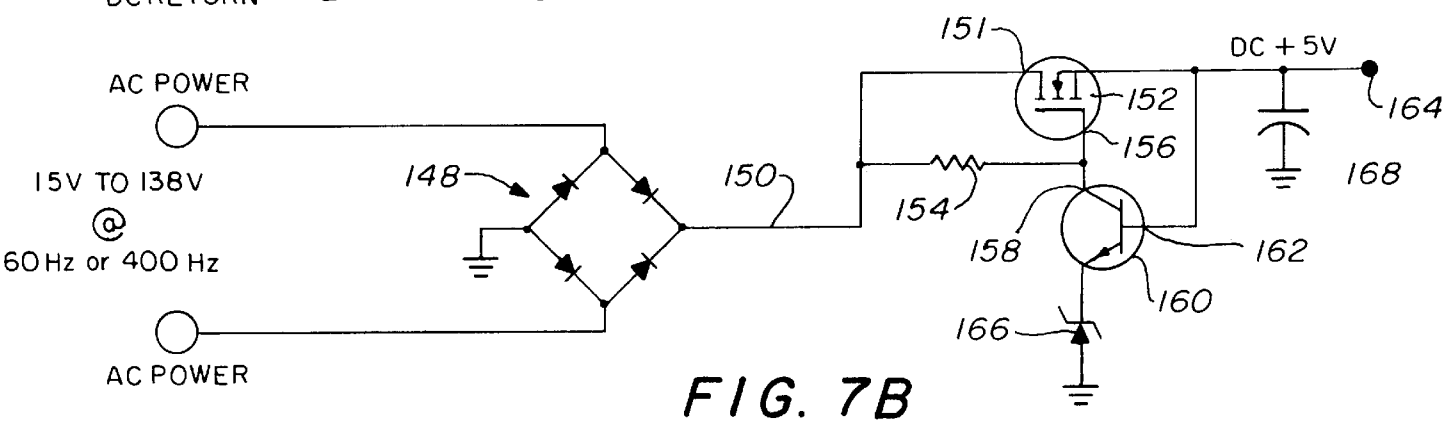
FIG. 7B

MULTIFUNCTIONAL DIGITAL INDICATOR

BACKGROUND OF THE INVENTION

1. Field of the Invention

The present invention relates to indicators and/or display units and more particularly to electronic MFDI (multifunctional digital indicators) or displays such as event counters or elapsed time indicators and the like which can preserve the status of the time or event display even in the event of a complete power loss for an indefinite period of time.

2. Description of Related Art Including Information Disclosed Under 37 CFR 1.97 and 1.98

There are numerous situations where the amount of time or elapsed time a machine or process runs may be of critical importance. The running time of a jet engine is one specific example. Likewise, there are numerous situations where the number of occurrences of a particular event or activity may also be important if not critical. However, the events may occur over a long period of time such as months or even years with complete unpredictability. Similarly, the running of the machine or process may start and stop at unpredictable times over lengthy periods. Consequently, it is important to be able to record the occurrence and/or amount of such unpredictable events and/or running time automatically and without having to maintain one or more individuals at the necessary locations to monitor and manually record such occurrences and running times.

In the past, events or elapsed time indicators which operated automatically without a human attendant, and which could maintain their status even in the event of complete loss of electrical power were typically mechanical clock-like devices or hybrid devices which included a significant amount of precision machining and provided mechanical-type displays which were electrically driven and electronically controlled. Excellent examples of such prior art devices are manufactured by Electrodynamics, Inc. in Rolling Meadows, Ill., the assignee of the present invention under the product name Dynatime®. Although such mechanical or hybrid devices provide excellent performance and dependability, such devices include a significant amount of precision clock-like machining which is expensive to produce and may be susceptible to damage by harsh environment and handling conditions.

Unfortunately, such devices having such a high content of precision manufacturing typically require substantially different designs for counting events and/or recording elapsed time. Further, such mechanical devices may also have high electrical power requirements.

SUMMARY OF THE INVENTION

Therefore, it is an object of the present invention to provide an efficient and dependable elapsed time or event counter which is both inexpensive to manufacture and to maintain.

It is a further object of the present invention to provide a single basic designed device which can be easily programmed for any one of several specific purposes and to operate from substantially any available power source.

It is yet another object of the present invention to provide a device which has form, fit, and function requirements such that the device can readily be substituted for existing mechanical and/or hybrid devices which perform the same functions.

These and other objects are achieved by the apparatus and methods of this invention for a multifunctional digital indicator which comprises an array of ChLCD (Cholesteric Liquid Crystal Display) elements such as is available from Advanced Display Systems of Amarillo, Tex. arranged in a plurality of rows and a plurality of columns. The array of ChLCD elements requires a first voltage of an absolute value to switch to a transparent state and a second voltage of an absolute value to switch to a reflective state. These voltages will hereinafter be referred to as $V_{TRANS}$ to indicate the voltage required to switch to the transparent state and $V_{BRIGHT}$ to indicate the voltage required to switch to the reflective state. The voltage $V_{BRIGHT}$ will typically be higher than the voltage $V_{TRANS}$. The display device will also include a power source providing a source of power having a voltage $V_{IN}$. According to one embodiment of the present invention, the input voltage $V_{IN}$ may be a DC voltage which has a voltage level varying between 14 to 35 volts DC with a nominal value of 28 volts DC. In addition, according to the present embodiment, the device can also accept an AC voltage between 15 to 138 volts AC RMS with a nominal voltage of either 26 volts or 115 volts and a frequency of 60 cycles per second or 400 cycles per second.

A controller or microcontroller receives the input data or information and provides the control signal for controlling the device of the invention. Also included in the device circuitry is a voltage multiplier circuit which receives the voltage input $V_{IN}$ and provides at least three output voltages such as $V_{MAX}$, $V_{MAX}/3$, and $2V_{MAX}/3$. The requirement to provide three voltages at these ratios will be discussed hereinafter, but briefly these voltages assure that the ChLCD elements change between the transparent and reflective state upon demand, but will not inadvertently change state during other voltage transitions.

The circuitry also includes a row driver which receives at least one of the output voltages from the voltage multiplier such as the $2V_{MAX}/3$ voltage. The row driver also can provide zero volts to the rows in the ChLCD array. Thus, according to one embodiment, the row driver will provide either zero volts or $2V_{MAX}/3$ volts to a selected one of the rows of the ChLCD elements in response to a control signal from the controller.

Also according to a preferred embodiment, there is provided a column drive circuit for each of the columns in the ChLCD array. Each of these drive circuits receives at least the $V_{MAX}$ voltage and the $V_{MAX}/3$ voltage from the voltage multiplier and selectively applies one of these voltages to each of the plurality of columns of the array in response to a control signal from the controller.

Because of peculiar operating characteristics of the ChLCD elements, the method of applying and removing specific voltages which are developed across the individual elements of the ChLCD array must follow a precise sequence. As will become clear hereinafter, it may be possible to have several sequences of events for the application of power which will properly operate the ChLCD elements. However, it is necessary that once one of the sequences has been decided upon and programmed into the controller of the device, this sequence must be followed if the device is to properly function and inadvertent changes of state are to be avoided.

Thus, according to one embodiment where the elements are "on" when in the "transparent" or $V_{TRANS}$ state and "off" when in the "reflective" or $V_{BRIGHT}$ state, the following sequence of steps is followed. All of the plurality of rows are set to zero and the voltage for all of the plurality of columns is set to the voltage $V_{MAX}$, where $V_{MAX}=V_{BRIGHT}$. Thus, the maximum voltage $V_{BRIGHT}$ will be across each of the elements such that the array is now erased and there are no elements in the "on" condition. A voltage $V_{HOLD}$ is then applied to the plurality of columns and in the present embodiment the voltage $V_{HOLD}=V_{MAX}/3$, where $V_{MAX}=V_{TRANS}$. Another voltage referred to as a "first" voltage is then applied to each of the rows of the plurality which includes at least one element of the multiplicity of elements which is selected to be in the "on" condition. According to the preferred embodiment being described, this first voltage is equal to "zero" volts. In a similar manner, a second voltage is applied to each of the remaining rows of the plurality of rows and according to the preferred embodiment this second voltage equals $2V_{MAX}/3$. A column voltage $V_{ON}$ is then provided for the necessary period of time to cause the change of state of the ChLCD elements to the "on" condition and in the preferred embodiment, the voltage $V_{ON}=V_{TRANS}$. The steps of applying the column voltage $V_{HOLD}$ through the step of applying the column voltage $V_{ON}$ are then repeated for each column which includes at least one element of the array which is selected to be in the "on" condition. Therefore, when all of the appropriate elements of the array have been selected to be "on" by the appropriate signals from the controller, according to the present embodiment a specific numeric display will be provided.

BRIEF DESCRIPTION OF THE DRAWINGS

These and other features of the present invention will be more fully disclosed when taken in conjunction with the following Detailed Description of the Preferred Embodiment(s) in which like numerals represent like elements and in which:

FIG. 5B is a chart showing an example of row and column connections for the display of FIG. 5A;

FIGS. 7A and 7B show the circuits for receiving DC power and AC power, respectively, by the device to provide a constant DC power output;

DETAILED DESCRIPTION OF THE PREFERRED EMBODIMENT(S)

Figure 1:
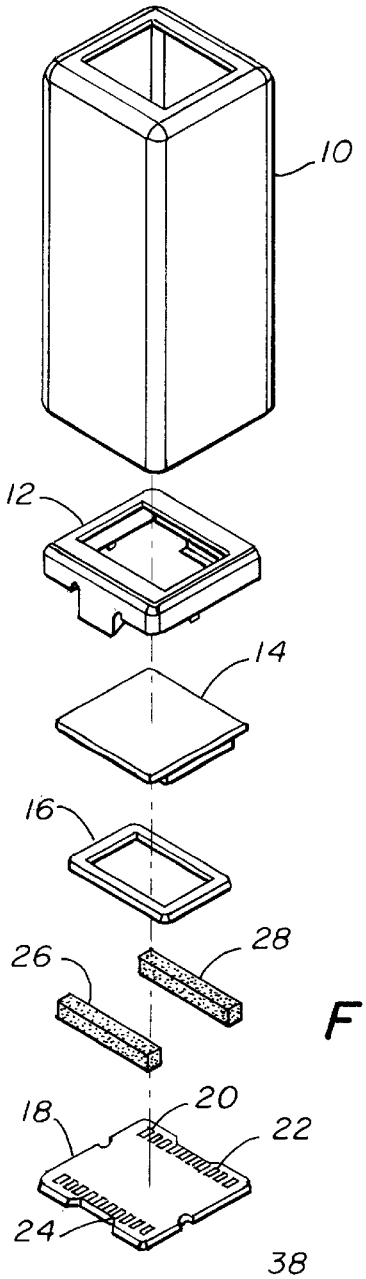
FIG. 1 is an exploded perspective view of a display device incorporating the teachings of the present invention.

Referring now to FIG. 1, there is shown an exploded view of the components according to one embodiment of a subminiature display indicator device according to the teachings of the present invention. As shown, there is a case 10 which receives a bezel 12 which in turn supports a ChLCD display element 14. Elastomeric connector strips 26 and 28 are provided between the ChLCD display device 14 and printed circuit board assembly 18, for purposes of providing connections to the device. The printed circuit board assembly 18 includes a series of connections such as pads 20, 22, and 24. Also included is a spacer 16 which supports the elastomeric connectors 26 and 28 and aids in the alignment of the connectors relative to the printed circuit assembly.

Figure 2A:
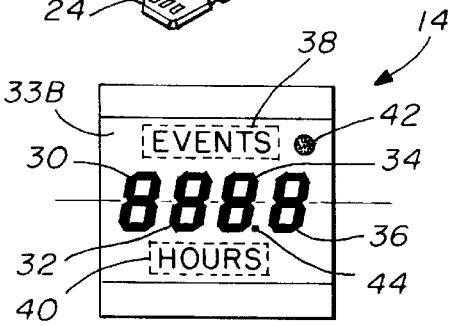
FIGS. 2A, 2B, and 2C represent a front view, a side view, and rear view of the ChLCD display panels with the multiplicity of elements which are turned "on" and "off" to provide specific numerical readouts.
Figure 2B:
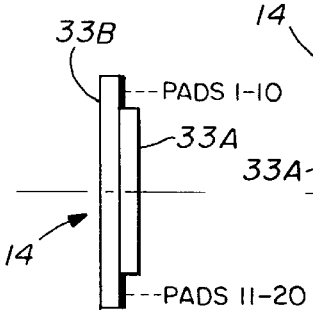
Figure 2C:
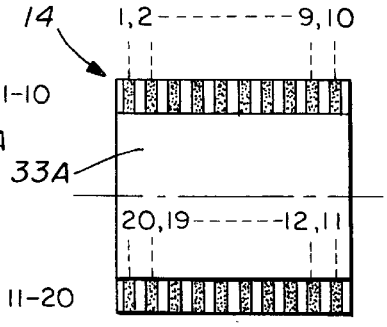

Referring now to FIGS. 2A, 2B, and 2C, there is shown a front view, an edge view, and a rear view of a ChLCD display 14 having 32 independent elements which can have their status changed from a transparent to a reflective state or from a reflective state to a transparent state in response to a control signal from a controller or a computer device to be discussed hereinafter. Side view FIG. 2B shows that these are two transparent plates. The rear plate carries reference number 33A, and the front plate carries reference number 33B.

In the embodiment shown, there are four numerical indicators 30, 32, 34, and 36. Each of these numeric indicators includes seven elements which can have their status changed from reflective to transparent or transparent to reflective in response to signals from the controller. Thus, each of the four numerical digits has seven elements for a total of 28 elements. In addition to the 28 elements required by the four numerical digits, there are also two label elements such as the "EVENTS" element 38 and the "HOURS" element 40. Finally, there is an operating indicator element 42 and a decimal element 44. Thus, there is a total of 32 elements in the ChLCD array. According to one preferred embodiment which will be described in more detail with respect to FIG. 4A, the 32 elements are controlled by a matrix of four columns and eight rows. Thus, as will become clear hereinafter, by properly applying voltages to the correct rows and columns, each of the elements can be individually controlled. Further, although there are 32 elements to be controlled, because of the matrix approach of eight rows and four columns, there is only a need to provide 12(8+4) input connections to the array. Referring now to the rear view shown in FIG. 2C of the ChLCD display array, there are shown 20 contact pads, 1–10 on one edge, and 11–20 on the second edge. However, as stated above, it will be appreciated that only 12 of the contact pads are used according to the present embodiment thus the 8 remaining contact pads are spares or in a different embodiment could be used for an array having eight rows and five columns.

Figure 3:
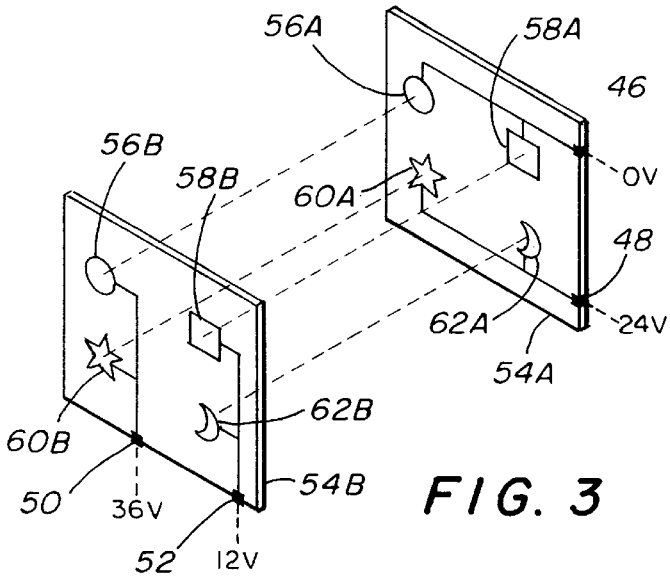
FIG. 3 is a simplified version of column and row connections provided for explanation purposes only.

Referring now to FIG. 3, there is shown a very simple array having two rows and two columns provided for the purpose of helping illustrate and aid in the understanding of the ChLCD type array. The two row inputs 46 and 48 are shown having a 0-volt input at terminal 46 and a 24-volt input at terminal 48, respectively. Likewise, the column input 50 is shown having a 36-volt input and the column input 52 is shown having a 12-volt input. The terminals 46 and 48 are on a first transparent plate 54A which includes metallic but transparent conductors having specific shapes or profiles such as the disk-shaped transparent conductor 56A and a square-shaped transparent conductor 58A on plate 54A. As can be seen, the row voltage applied to these transparent conductive shapes through terminal 46 is zero volts. Likewise, the star-shaped transparent conductor 60A and the crescent-shaped transparent conductor 62A receive 24 volts from the terminal 48. In a similar manner, transparent plate 54B also includes transparent conductors having the same four shapes of the disk 56B, square 58B, star 60B, and crescent 62B. This transparent plate 54B has no row connections but instead the transparent conductors are connected to the column terminals 50 and 52. As shown, the transparent conductor 56B having a disk shape and the transparent conductor 60B having a star shape each receives 36 volts from terminal 50 while the square-shaped transparent conductor 58B and the crescent-shaped transparent conductor 62B receive 12 volts DC from column terminal 52. As will be appreciated by those skilled in the art, a liquid crystal material is encased by the two plates 54A and 54B such that, when a voltage of a first specific level is applied between the two transparent conductive pads, the liquid crystal material will be reflective to light. However, when a second and lower voltage is applied, the liquid crystal material will be transparent to light. Thus, in the examples shown in FIG. 3, the voltage level between the two disk-shaped transparent conductive pads (56A and 56B) has an absolute value of 36 volts, whereas the voltage between the star pads (60A and 60B), the square pads (58A and 58B), and the crescent pads (62A and 62B) each has an absolute value of 12 volts. For example, with respect to the disk, the row voltage on terminal 46 provides a zero voltage level, whereas terminal 50 provides a 36 voltage level for a total of a 36-volt absolute value. The square pads, on the other hand, have a 0-volt row input and 12-volt column input for an absolute value of 12 volts. The star, on the other hand, has a 24-volt row input and a 36-volt column also for an absolute value of 12 volts. Likewise, the liquid crystal material between the crescent-shaped pads is subjected to a 24-volt row input and a 12-volt column input also for an absolute value across the liquid crystal material of 12 volts. As was stated before, the device illustrated in FIG. 3 is for explanatory purposes to show how the application of various voltages on the row and column input terminals can be used to control which of the individual elements in an array receive the necessary power to create a change of state.

Figures 4A, 4B:
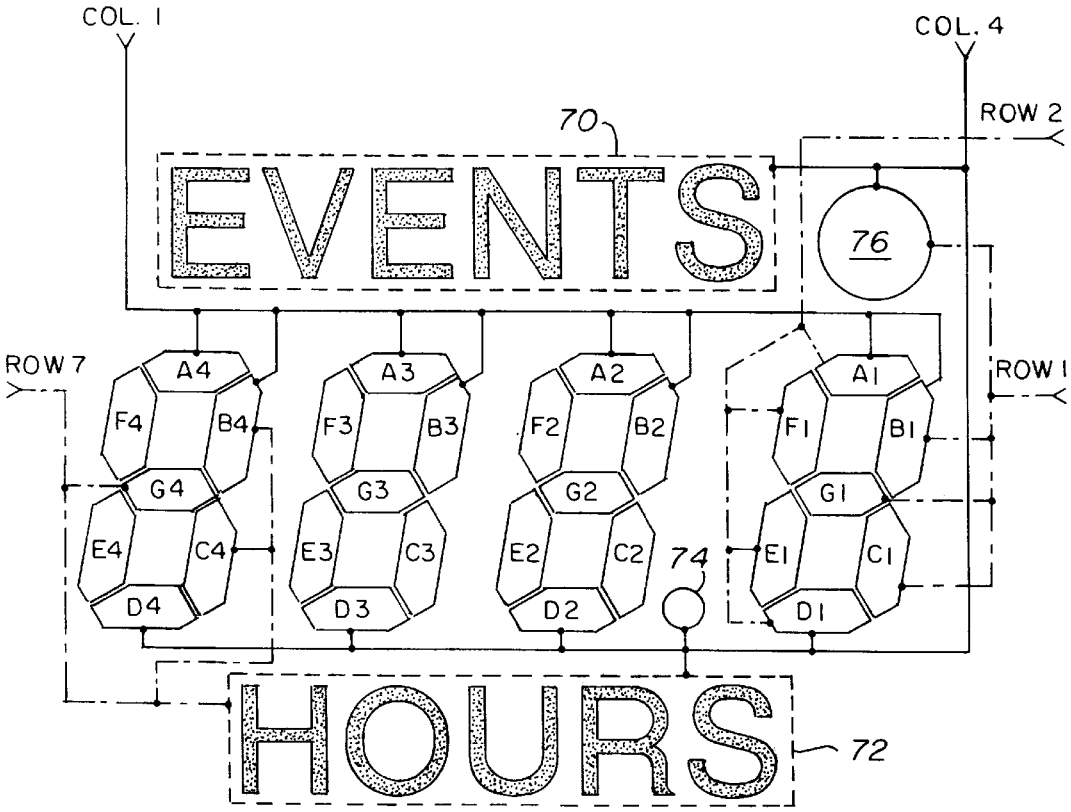
FIG. 4A shows an example of how individual elements or segments of a display according to one embodiment of the present invention could be connected to the appropriate row and column terminals.
FIG. 4B is a chart showing the required row and column connections for the display of FIG. 4A according to a preferred embodiment of the present invention.

Referring now to FIG. 4A, there is shown a more complex arrangement of elements according to one preferred embodiment of the present invention. In the embodiment shown, it is clear from the chart in FIG. 4B, that the eight rows and four columns can be arranged in almost in any manner and in any location for controlling the 32 possible elements of the display. Again for illustration purposes, only the rows 1, 2, and 7 and columns 1 and 4 electrical connections will be illustrated. However, it will be appreciated that the remaining rows and columns are all connected to rows and columns as indicated in the chart in FIG. 4B, and operate in a similar manner as those discussed such that each of the individual elements of the array can be selectively controlled to change their state from a transparent to reflective or reflective to transparent condition. In the illustration of FIG. 4A, the dashed or dotted line connections represent an input from the row terminals on one plate, whereas the solid line connections represent the column input on the second plate. The electrical routing and connections as indicated in FIG. 4A are for illustrative purposes only and the actual electrical routing interconnections may vary significantly from those that are shown. The important point is to understand that each element of the array, whether it is one of the seven elements of one of the four digits, or the element is one of the label elements such as the "HOURS" and "EVENTS", is individually addressed by a row and column voltage.

For example, it can be seen that column 1 is connected to the A4, B4, A3, B3, A2, B2, A1, and B1 segments of the four numerical displays, whereas column 4 is connected to the "EVENTS" label 70, the "HOURS" label 72, the decimal (.) 74, and the operating indicator 76 as well as the elements D1, D2, D3, and D4 of the individual numeric digit displays. Row 1, on the other hand, located on the opposite transparent plate such that the liquid crystal material is contained between the two plates is connected to the operating indicator 76 and the B1, C1, and G1 elements of the rightmost numerical display, whereas row 2 is connected to the A1, F1, E1, and D1 elements. Row 7 is connected to the "HOURS" label 72 as well as the G4, B4, and C4 elements of the leftmost numerical display. The remaining rows and columns as discussed above will be connected to the individual elements of the array (although not shown in FIG. 4A) as indicated in the table or chart shown in FIG. 4B. Thus, it will be appreciated that to turn the "HOURS" label "on", the appropriate absolute voltage must exist between the connection of row 7 and column 4. Similarly, to turn the A1 element of the rightmost numerical display "on", the appropriate voltage must exist between row 2 and column 1. However, to turn "on" the B1 element of the rightmost numerical display, the necessary voltage must exist between row 1 and column 1. Thus, it will be appreciated that by selectively applying the appropriate voltages to the individual row terminals and the individual column terminals, each of the 32 elements of the display array may be selectively turned "on" or "off". That is, they may be selectively controlled to change state between transparent or reflective.

Figure 5A:
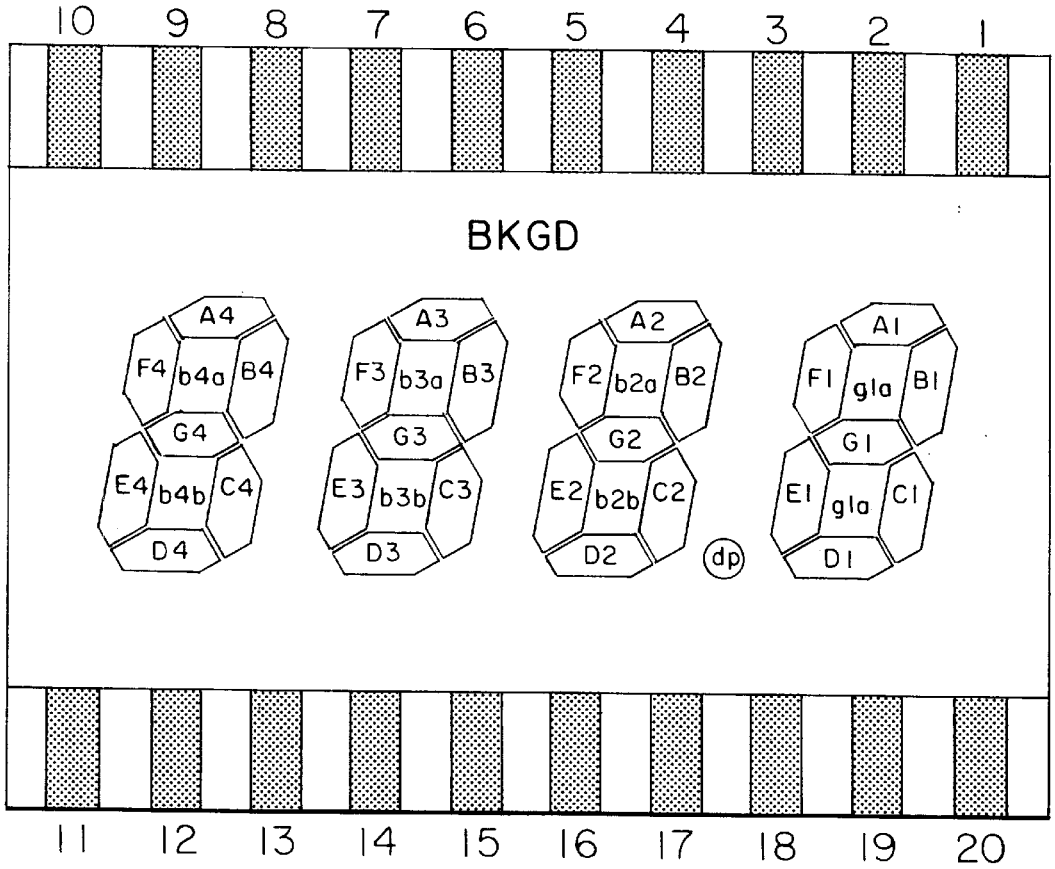
FIG. 5A shows another preferred embodiment of a display according to the teachings of the present invention.

Referring to FIGS. 5A and 5B there is shown another preferred embodiment of the present invention where the entire display is controlled or written, including the background. The ability to write the "background" as well as those portions of the display which provide information will be necessary for applications where the temperature of the display exceeds a maximum or threshold temperature such as for example 90° C. If the threshold temperature is exceeded, the LCD fluid between the two conductive plates will be affected such that the entire display (including the background) will go to the transparent state (i.e., appear to be black).

This state change will probably not damage the display, and once the temperature drops below the threshold level it can again be addressed so as to control the individual elements as necessary. However, if the background is not also addressable, it will remain in the transparent state and continue to be black. Thus, it will be appreciated that for certain applications it is necessary to also address the background of the display.

Therefore, as shown in FIGS. 5A and 5B there may be provided a multiplexing scheme wherein the various portions of the display background are addressed. The display shown in FIG. 5A includes the same four numerical digits and the decimal point as was discussed with respect to FIG. 4A. However, unlike FIG. 4A, FIG. 5A includes addressable background elements surrounded by the various elements making up each of the four numerical displays. For example, the right numerical display made up of addressable elements A1, B1, C1, D1, E1, F1 and G1 also includes addressable background elements 61A and 61B. As shown in FIG. 5A, the remaining three numerical displays also include similar addressable background elements. In addition, the overall or outside background which surrounds the four numerical displays and the decimal point is addressable. In the embodiment shown in FIG. 5A, it will also be appreciated that there are no "EVENTS" or "HOURS" elements and that the wiring connections to the appropriate Row and Column inputs have not been shown.

However, although not shown in FIG. 5A, the wiring connections to the Row and Column input may be similar to those shown in FIG. 4A or any other convenient arrangement. The Table of FIG. 5B shows a multiplexing scheme suitable for the display of FIG. 5A and includes row and column connections for the outside background labeled "BKGD" as well as the eight smaller background elements such as elements b1a and b1b.

In addition to being affected by high temperature, the LCD fluid used is often sensitive to mechanical pressure such that it will be changed to the bright state. Therefore, to make the display less sensitive to touch or mechanical pressure, it may be desirable to add several small parts or bumps within the display to protect the display from various mechanical pressures, including touch.

Table I illustrates how changes in temperature of between 80° C. and −40° C. (shown in the leftmost column) effect the voltage and voltage duration requirements for the ChLCD material to change to either the "reflective" or the "transparent" state. The left half of the table shows the amount of time in milliseconds (ms) that the voltage $V_{BRIGHT}$ (60V) must be applied across an element to switch the element to a "reflective" state at different temperatures, and the time the voltage $V_{TRANS}$ (35V) must be applied to switch the element to a "transparent" state at different temperatures. The right side of the table shows a constant time period (250 ms) that a voltage is applied to an element and the required voltage to switch to either a reflective or transparent state depending upon the temperature.

TABLE I

| Temp | CONSTANT VOLTAGE | | | | CONSTANT TIME | | | |
|---|---|---|---|---|---|---|---|---|
| (° C.) | $V_{BRIGHT}$ | @ ms | $V_{TRANS}$ | @ ms | $V_{BRIGHT}$ | @ ms | $V_{TRANS}$ | @ ms |
| 70 | 60 | 3 | 35 | 2 | 42 | 250 | 8.0 | 250 |
| 60 | 60 | 4 | 35 | 5 | 44 | 250 | 10.5 | 250 |
| 50 | 60 | 5 | 35 | 8 | 45 | 250 | 14.0 | 250 |
| 25 | 60 | 12 | 35 | 14 | 45 | 250 | 21.0 | 250 |
| 0 | 60 | 27 | 35 | 35 | 47 | 250 | 26.0 | 250 |
| −10 | 60 | 52 | 35 | 100 | 52 | 250 | 30.0 | 250 |
| −20 | 60 | 130 | 35 | 200 | 57 | 250 | 34.0 | 250 |
| −30 | 60 | 400 | 35 | 700 | 65 | 250 | 44.0 | 250 |
| −40 | 60 | 1000 | 35 | 1000 | — | — | — | — |

Figure 6:
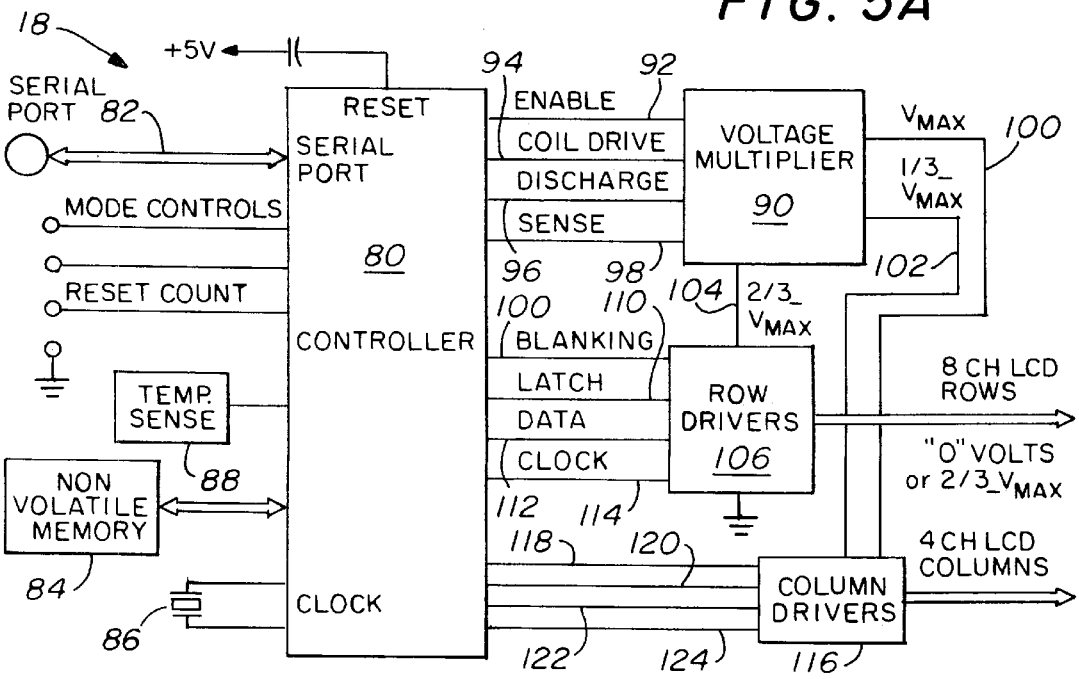
FIG. 6 is a block diagram showing the electronic circuitry which controls the display device of the present invention.

Referring now to FIG. 6, there is shown the control circuitry 18 for the ChLCD display array 14. As shown, the circuit is controlled by a controller or microcontroller 80 which calculates elapsed time. There is also provided to controller 80 a serial port input 82 which is used for diagnostics and retrieving displayed data electronically. A memory 84 such as a nonvolatile Random Access Memory (nov RAM) is typically used and connected with the microcontroller 80 for permanently storing data, such as the last elapsed time written to the display. Also connected to the microcontroller 80 is a crystal 86 which provides an input to a clocking circuit in the microcontroller 80 such that, if elapsed time is to be the selected display, the elapsed time output will be precise. As will be recalled with respect to Table I, the voltage level or the pulse duration of the voltage required to generate a change of state of the elements varied with changes in temperature. Therefore, there is also included a temperature-sensing unit 88 (such as a thermistor) which provides an input to the controller 80 such that the controller 80 can change the voltage output level of the voltage multiplier 90. As shown in the present embodiment, the microcontroller 80 provides four control signals to the voltage multiplier 90 including the enable signal, the coil drive signal, the discharge signal, the sensing signal on lines 92, 94, 96, and 98, respectively. The manner in which these four control signals from microcontroller 80 controls voltage multiplier 90 will be discussed in detail hereinafter. It should be noted at this point, however, that voltage multiplier 90 provides three outputs, a $V_{MAX}$ voltage on line 100, a one-third (⅓) $V_{MAX}$ on line 102, and a two-thirds (⅔) $V_{MAX}$ on line 104. The $2V_{MAX}/3$ is applied in the present embodiment to the row driver circuits 106. According to the present embodiment, there are eight row drivers, each of which can provide either "0" voltage or a $V_{MAX}$ to each of the row terminals on the ChLCD display 14. Also as indicated by the input signals from controller 80, the row drivers typically comprise a shift register or a commercial vacuum fluorescent driver and receive four control circuits such as a blanking control signal on line 108, a latching signal on line 110, a data signal on line 112, and a clocking signal on line 114. Thus as will be understood, the row drivers can provide an output of zero volts or the (⅔) $V_{MAX}$ voltage received on 104 to each of the rows on the ChLCD display. It will also be noted, that the voltage $V_{MAX}$ on line 100 and the one-third voltage $V_{MAX}$ on line 102 are both provided to the four column driver circuits indicate by reference numeral 116. The four column drivers 116 are controlled by the four control signals on lines 118, 120, 122, and 124 from controller 80. The column drive circuit will be discussed in more detail hereinafter.

It will be recalled that according to the preferred embodiment, the display device of the present invention preferably is capable of operating on both AC and DC power and also at various power levels and frequencies for the AC power. As shown in FIG. 7A, DC power between 14 volts and 35 volts will be applied to the input terminal 130 through blocking diode 132 and to the filtering resistor and capacitor 134 and 136. The power is provided to voltage regulator 140 which reduces the voltage output of the regulator at terminal 142 to a value of 5 volts DC on terminal 144. Also included is a filter capacitor 126. Thus, it can be seen that a DC voltage having a level between 14 and 35 volts can be provided to the display device and the voltage regulator will maintain a constant 5-volt DC output for operating the device.

In a similar manner and as shown in FIG. 7B, AC power having a voltage level of between about 15 and 138, and having a frequency of between 60 cycles per second and 400 cycles per second is applied across a full-wave rectifier indicated generally by reference numeral 148. The positive output of full-wave rectifier 148 on line 150 is provided to the "drain" 151 of an N-channel FET (field effect transistor) 152 and through a resistor 154 to the gate 156 of FET 152 and the collector 158 of transistor 160. The source of FET 152 is provided to the base 162 of transistor 160 such that the rectified AC voltage is clamped to a value of 5-volts DC on terminal 164 by the transistor 160 and the zener diode 166 acting on the gate 156 of FET 152. Also included is filtering capacitor 168 to convert the rectified AC to DC voltage.

Although discussed earlier, it is important to understand the unusual operating characteristics of a ChLCD display. Namely, this type of array requires a relatively high voltage to put the material in a "reflective" or "bright" state. This voltage is referred to in the following portions of the discussion as $V_{BRIGHT}$ and is typically on the order of about 60-volts DC absolute. That is, polarity of the voltage across the material is not important so long as the total voltage across the material is equal to $V_{BRIGHT}$. A lower voltage is required to put the material in a transparent state. This voltage is typically on the order of about 36-volts and is referred as $V_{TRANS}$. Finally, if the voltage is maintained below a still lower value, the material will remain in its current state whether it is in a reflective or transparent state. This lower voltage value is about 24-volts DC. Thus, if the material is in either a reflective or transparent state and the applied voltage across the material does not exceed 24-volts DC absolute, the material will not change states.

Also as was discussed earlier, the signals or elements of the ChLCD display are multiplexed to minimize the number of connections required to drive the display. Consequently, the voltage must be applied to the multiplexed rows and columns in a sequence that assures that none of the segments unintentionally change states. That is, the absolute voltage across the segments not being addressed must not be allowed to reach a level which would cause a change in the state or condition of the material.

One scheme that satisfies this requirement consists of all of the elements first being "erased" by being placed in the "reflective" or "off" state. It will be recalled this state requires a voltage of approximately 60V. The columns are then driven to a voltage $V_{HOLD}$ that is one-third the transparent state (i.e., $V_{TRANS}/3$), while the rows are normally being driven to $2V_{TRANS}/3$. When a specific segment is to be transitioned from the reflective or "off" state to the transparent or "on" state, its row is set to zero volts and its column is set to $V_{TRANS}$. This causes the specific segment to transition, while all the other segments are unchanged since as will be discussed later, the voltages across the remaining segments will always remain between plus or minus $V_{TRANS}/3$. It will be appreciated, of course, that other schemes may also be suitable and that although the present description refers to a matrix having eight rows and four columns, these designations are for convenience only and are somewhat arbitrary. There could just as easily be eight columns and four rows. Thus, it should be understood that the use of such terms as "rows" or "columns" is for convenience only and these terms are not to be considered limiting to the scope of the invention.

In one preferred embodiment of the present invention as has been discussed, the array of segments are considered to be "on" when they are in the transparent stage (i.e., have been last subjected to a voltage $V_{TRANS}$ of about 36 volts) and "off" when they are in a reflective state (i.e., have been last subjected to a voltage of about 60 volts $V_{BRIGHT}$). However, as will be appreciated by those skilled in the art, the array could be controlled such that the reflective state ($V_{BRIGHT}$) is "on" and the transparent state ($V_{TRANS}$) is "off".

Also, according to the preferred embodiment "on" is the transparent state set by a voltage $V_{TRANS}$ and the required voltage for switching will be determined as follows:

There will be four drive or voltage states for the full multiplicity of LCD segments and are determined as follows:

1. The appropriate row voltage of the matrix is selected such that a voltage $V_{RS}$ is applied to the element, and the corresponding column is enabled by the application of a voltage $V_{CE}$. The resulting voltage across the segment ($V_{SEG}$) for this condition will be $V_{SEG}=V_{RS}-V_{CE}$.
2. The appropriate row voltage of the matrix is selected such the voltage $V_{RS}$ is applied to the element, and the corresponding column is disabled by the application of a voltage $V_{CD}$. The resulting voltage $V_{SEG}$ across the segment or element for this condition will therefore be $V_{SEG}=V_{CD}-V_{RS}$.
3. The appropriate row voltage of the matrix is unselected such that a voltage $V_{RU}$ is applied and the corresponding column is enabled by the application of a voltage $V_{CE}$. The resulting voltage $V_{SEG}$ in this case will be $V_{SEG}=V_{CE}-V_{RU}$.
4. The last possible voltage is where the appropriate row of the matrix for the element is unselected such that a voltage $V_{RU}$ is applied and the corresponding column voltage is disabled by the application of a voltage $V_{CD}$. In this situation, the voltage $V_{SEG}=V_{CD}-V_{RU}$.

If the voltage $V_{TRANS}$ will set an element or segment to the transparent state (which is "on" in this embodiment), then only the first situation discussed above $V_{SEG}=V_{RS}-V_{CE}$ where the row is selected and the column is enabled must allow the voltage across the segment to reach the $V_{TRANS}$ level. The other three conditions where either one of the appropriate columns of a segment must be unselected or the corresponding row must be disabled (or where both the column is unselected and the row disabled) must maintain the absolute voltage across the segment below $V_{TRANS}$.

Thus, the voltages $V_{CD}$, $V_{CE}$, $V_{RS}$, and $V_{RU}$ may further be determined as follows: Set the voltage required for the "on" or transparent state $$V_{TRANS}=V_{RS}-V_{CE}$$

(i.e., the row is selected and the column is enabled) and let $V_{RS}=0$ . Therefore, the absolute value of $V_{CE}=V_{TRANS}$, since $V_{RS}=0$.

Then set the three other possible conditions equal to each other. That is, the absolute value of $V_{CE}-V_{RU}$ equals the absolute value of $V_{CD}-V_{RU}$ which equals the absolute value of $V_{CD}-V_{RS}$ such that $$V_{CE}-V_{RU}=V_{CD}-0=V_{CD}-V_{RU}$$

which can be reduced so that the absolute value of $V_{CE}-V_{RU}$ equals the absolute value of $V_{CD}-V_{RU}$ equals the absolute value of $V_{CD}$. Thus, $V_{TRANS}-V_{RU}=V_{CD}$ and $2V_{CD}=V_{RU}$. This reduces to $V_{TRANS}-(2V_{CD})=V_{CD}$ such that $V_{TRANS}/3=V_{CD}$.

Thus from these equations it is clear that $V_{CE}=V_{TRANS}$, $V_{RS}=0$, $V_{CD}=V_{TRANS}/3$, and $V_{RU}=2V_{TRANS}/3$.

Referring now to Table II where $V_{TRANS}$ is equal to 36 volts, and using the remaining voltages as calculated above, there is shown a graphic representation of the possible voltages which can be applied to the rows and columns of the matrix, and the resultant absolute value of voltages across the segment.

TABLE II

| | Row Selected V = 0V | Row Unselected V = 24V ($2V_{TRANS}/3$) |
|---|---|---|
| Column enabled $V_{TRANS}$ = 36V | 36V | 12 |
| Column disabled $V_{TRANS}/3$ = 12V | 12 | 12 |

Thus, with these voltages available for driving the array, a particular display may be set according to the following steps:

1. Measure the ambient temperature and determine the voltage $V_{BRIGHT}$ and the amount of time of the pulse duration to make a transition to $V_{BRIGHT}$ (as shown in Table I). In a similar manner, determine the voltage $V_{TRANS}$ and the time pulse required for changing the state to the transparent state. For further purposes of explanation, assume $V_{BRIGHT}$ is to be 60 volts and $V_{TRANS}$ is to be 36 volts;
2. Set all rows to zero volts;
3. The display may then be erased by setting all columns to $V_{BRIGHT}$ (60V) for the time necessary to make the transition to the reflective state;
4. The required segments for each column are then set as follows:
   (a) Set all columns to $V_{HOLD}(V_{TRANS}/3)$;
   (b) Set all rows to either zero volts (as a first voltage) for an "on" element, or $2V_{TRANS}/3$ (as a second voltage) for no change. That is, the segment will ultimately remain in the bright or reflective state;
   (c) Set the column that includes an element to be turned "on" to $V_{TRANS}$ for the required amount of pulse duration; and
   (d) Repeat steps 4(a), (b), and (c) above for each remaining column.
5. Finally, set all rows to zero volts; and
6. Set all columns to zero volts.

As was mentioned above for some applications it may be preferable to operate the ChLCD array such that the transparent state is "OFF" and the reflective state is "ON". Therefore, using similar calculations as discussed above, the voltages necessary for controlling the array when the reflective state is on can be determined. Thus, $V_{MAX}=V_{BRIGHT}$ (60V); $2V_{MAX}/3=2V_{BRIGHT}/3$(40V); and $V_{MAX}/3=V_{BRIGHT}/3$(20V); and the voltage available to apply to the row and column terminals of the array would be

TABLE III

| | When Row Selected apply "0" Volts | When Row Unselected apply 40 Volts |
|---|---|---|
| When column enabled apply 60 Volts | 60 | 20 |
| When column disabled apply 20 Volts | 20 | 20 |

Also in a manner as discussed above, the sequence for controlling the elements of the arrays would be substantially the same, except to "erase" the array, all elements would first be set to $V_{TRANS}$ or 36 Volts.

The overall sequence would be:

1. Measure the ambient temperature and determine the voltage $V_{TRANS}$ and the amount of time of the pulse duration to make a transition to $V_{TRANS}$ (as shown in Table I). In a similar manner, determine the voltage and duration required to change the state to the reflective state.
2. Set all rows to zero volts.
3. The display is then erased by setting all columns to $V_{TRANS}$ (36 Volts) for the time necessary to make the transition to the transparent state.
4. The required segments for each column are then set as follows:
   a. Set all columns to $V_{HOLD}$ ($V_{BRIGHT}/3$ or 20 volts)
   b. Set all rows to either zero volts (as a first voltage) for an "on" element, or $2V_{BRIGHT}/3$ or 40 volts (as a second voltage) for no change. It should be noted that although the 40 volts of $2V_{BRIGHT}/3$ is greater than the 36 volts required for a "transparent" state, since all of the rows have previously been set to 20 volts, the absolute value will also be 20V (i.e., 40−20V=20V). Thus the segment will ultimately remain in the transparent state.
   c. Set the column that includes an element to be turned "ON" to $V_{BRIGHT}$ for the correct pulse duration; and
   d. Repeat steps 4(a), (b) and (c) above for each remaining column.
5. Finally, set all rows to zero volts; and
6. Set all columns to zero volts.

Figure 8:
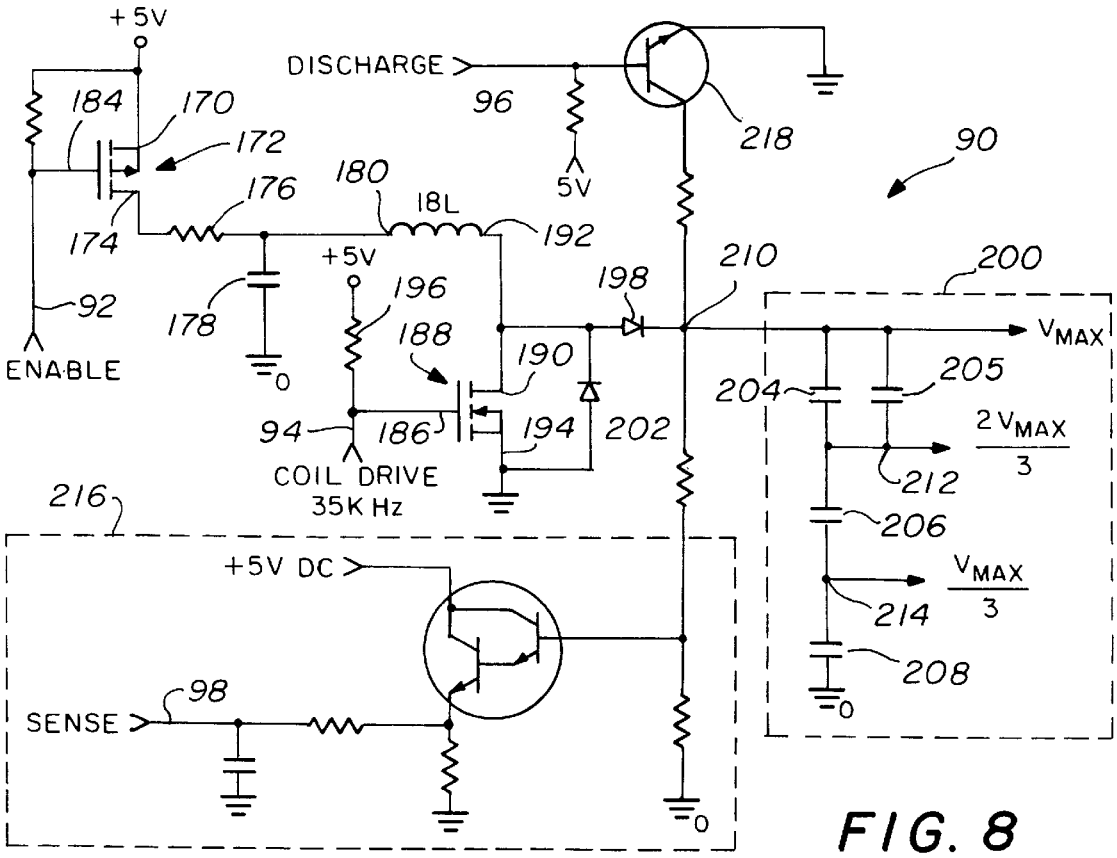
FIG. 8 shows the voltage multiplier circuitry used by the present invention.

Referring now to FIG. 8 along with the block diagram of FIG. 6, the voltage multiplier circuit 90 will be discussed.

Since the ChLCD display requires relatively high voltages to drive it, and the primary power supply voltage is 5-volts DC as has been discussed earlier, a voltage multiplier circuit 90 is employed to raise the voltage to the required levels. Also, as will be understood, the voltage is divided into thirds as required by the multiplexing scheme. As was discussed earlier, controller 80 will generate the power enable signal on line 92 so as to save power when the indicator is not running. A coil drive signal to switch the coil "on" and "off" will be generated on line 94. There is also a discharge signal which is provided on line 96 to rapidly discharge the maximum voltage output of the multiplier so that a transition of the output voltage $V_{MAX}$ of the multiplier from $V_{BRIGHT}$ to a voltage lower than $V_{TRANS}$ will not stay at the $V_{TRANS}$ level long enough to result in an unintended change from the reflective to the transparent state. Finally, there is a voltage sense connection on line 98 which provides a switched RC timing signal so as to provide a voltage level back to the controller 80 so that the output voltage $V_{MAX}$ of the multiplier will selectively be at $V_{BRIGHT}$ (60 volts) or $V_{TRANS}$ (36 volts) as desired.

As shown, the "source" 170 of FET 172 is connected to the 5-volt DC input power, and the "drain" 174 of FET 172 is connected through the RC filter (resistor 176 and capacitor 178) to the high side 180 of coil 182. In addition, when the enable signal for controller 80 is not present, the gate 184 of FET 172 is maintained at a high level so that the FET 172 does not conduct. Upon receiving the enable signal on line 92 from controller 80, FET 172 is put in a conductive state such that substantially the full 5-volt DC power is available at the high side 180 of coil 182. It will be recalled that according to the embodiment being discussed, the reflective state is "off" and the transparent state is "on". However, the output voltage $V_{MAX}$ of the voltage multiplier must first reach a level of $V_{BRIGHT}$ or approximately 60 volts to erase any existing information on the display. Thus, the 35 kHz coil drive signal on line 94 is applied to the gate 186 of a second FET 188 which has its "drain" 190 connected to the low side 192 of coil 182 and its "source" 194 connected to ground. Before the 35 kHz coil drive signal is applied to the gate 186 of FET 188, the FET 188 is maintained in a conductive state by the 5-volt DC power connected to the gate 186 through resistor 196. As will be appreciated by those skilled in the art, turning FET 188 "on" and "off" at a high rate (for example, 35 kHz) will result in the creation of a high back EMF across coil 182. This high voltage from the back EMF passes through blocking diode 198 to the Capacitive Voltage Divider circuitry 200. Another diode 202 is connected across FET 188 so as to protect the FET 188 from the high voltage levels resulting from the back EMF of the coil 182.

The Capacitive Voltage Divider 200 comprises three primary capacitors 204, 206, and 208 which are of equal capacitive value such that the voltage $V_{MAX}$ applied to the top side of the first capacitor 204 is divided into thirds. A substantially smaller capacitor 205 is shown in parallel with capacitor 204 to avoid an excessive voltage drop at the voltage (⅔) $V_{MAX}$ due to uneven current load from the rest of the device. Thus, the voltage at the connection point 212 at the bottom of the first capacitor 204 and the top side of the second capacitor 206 is $2V_{MAX}/3$ and the voltage at the connection point 214 at the bottom side of the second capacitor 206 and top side of the third capacitor 208 is $V_{MAX}/3$. Thus, it will be appreciated that if $V_{MAX}$ is equal to $V_{BRIGHT}$ (or approximately 60 volts), then the three output voltages would be $V_{BRIGHT}$ (60 volts), $2V_{BRIGHT}/3$ (40 volts), and $V_{BRIGHT}/3$ (20 volts). Likewise, if $V_{MAX}$ is $V_{TRANS}$ (36 volts), then the three output voltages are $V_{TRANS}$ (36 volts), $2V_{TRANS}/3$ (24 volts), and $V_{TRANS}/3$ (12 volts).

Therefore, to generate a $V_{BRIGHT}$ voltage of 60 volts, sensing circuit 216 continuously monitors the output voltage $V_{MAX}$ and the 35 kHz coil drive signal is continuously applied until the voltage level reaches $V_{BRIGHT}$ (60 volts). Once the $V_{MAX}$ voltage reaches the $V_{BRIGHT}$ level, the 35 kHz coil drive signal is then selectively applied to maintain $V_{MAX}$ at the $V_{BRIGHT}$ level so long as the voltage $V_{BRIGHT}$ is required. It will be recalled that $V_{BRIGHT}$ is used in the present embodiment only for the purpose of "erasing" all of the segments by setting them to the "reflective" or "off" state. However, other schemes could use the reflective state as "on" and the transparent state as "off".

After all the segments are "erased", the power enable signal on line 92 is preferably turned "off" while the discharge signal from controller 80 is applied on line 96. The discharge signal on line 96 turns "on" transistor 218 to connect connection point 210 to ground so as to quickly discharge the capacitors in the Capacitor Voltage Divider 200. After the voltage divider capacitors have been discharged, the discharge signal is removed to turn "off" transistor 218 and the power enable signal is again applied to the high side 180 of coil 182. The 35 kHz coil drive signal is again applied to charge the capacitors 204, 206, and 208 in the capacitive voltage driver 200. However, since the necessary output voltage for turning "on" the selected element of the array (i.e., putting the elements in the transparent state) must be 36 volts, but less than 60 volts, the sensing unit 216 will monitor $V_{MAX}$ so as to maintain the 35 kHz coil drive signal to FET 188 until $V_{MAX}$ equals $V_{TRANS}$ or approximately 36 volts. At that point, the 35 kHz coil drive signal will only be applied as necessary to maintain $V_{MAX}$ at the $V_{TRANS}$ level. With a $V_{MAX}$ output of $V_{TRANS}$ (36 volts), the other two voltage outputs will be $2V_{TRANS}/3$ (24 volts) and $V_{TRANS}/3$ (12 volts). These are, of course, the voltages discussed above which will selectively be applied to the rows and/or columns of the display matrix to turn "on" only those selected segments.

Figure 9:
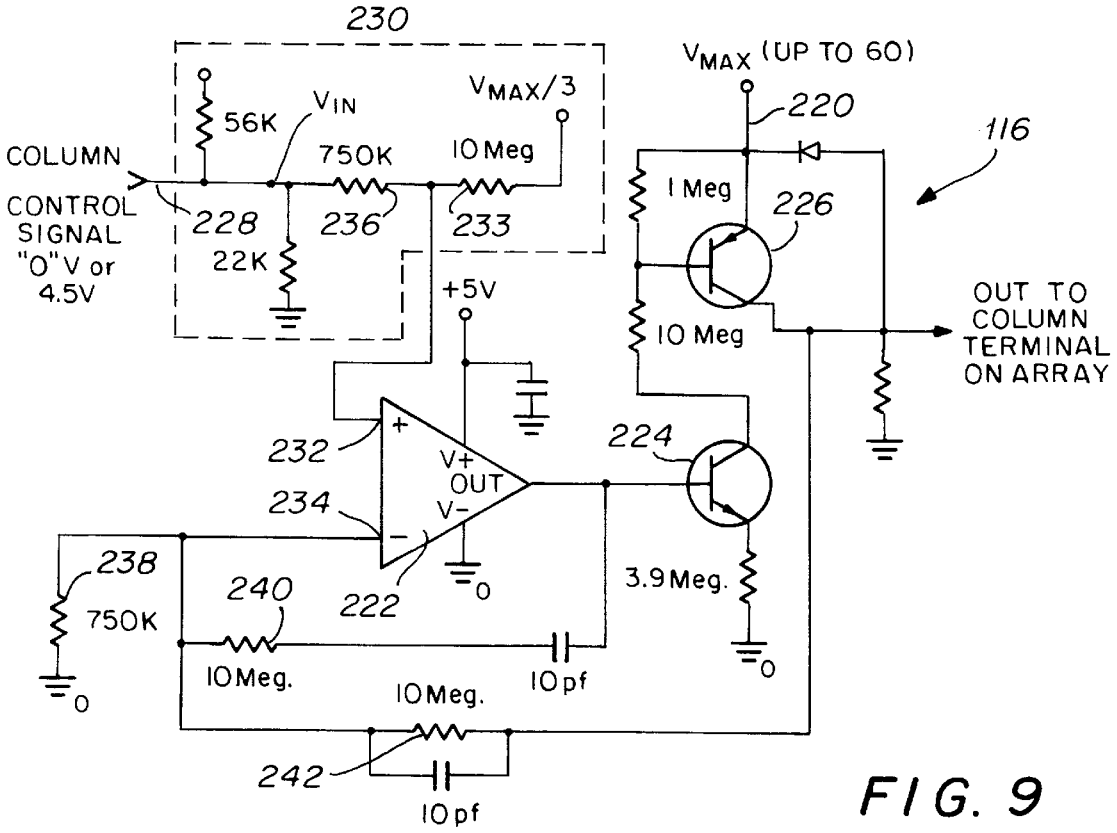
FIG. 9 shows the column drive circuit for the ChLCD elements used in the display device of the present invention.

Referring now to FIG. 9, the apparatus of the column drive circuit is as follows. It will be recalled that according to the described embodiment, the number of column drive circuits of the array shown in FIG. 5 will be equal to the number of columns used in the matrix array. Each circuit 116 consists of a low voltage op amp 222 augmented by high voltage transistors 224 and 226 to allow direct control of high voltages up to 60 volts DC on line 220 from voltage multiplier 90. The input signal will be zero volts if the column voltage should be $V_{TRANS}/3$, or the voltage will be the full approximately 4.5 volts if the column voltage should be at $V_{TRANS}$ (or $V_{MAX}=V_{BRIGHT}$ during the erase mode).

These voltages are controlled by a summing junction 230. The summing junction receives the controller 80 column signal on line 228 which will typically be zero volts or 4.5 volts DC and a $V_{MAX}/3$ voltage from the voltage multiplier which goes to the noninverting input 232 of the op amp 222 through resistor 233). At the same time, the inverting input 234 of op amp 222 receives a voltage divider junction feedback signal so that the DC gain of the op amp 222 is set to 14. The final output stage consists of the high-voltage transistors 224 and 226 which are controlled by the output of the op amp 222 and are powered by the $V_{TRANS}$ voltage from the voltage multiplier. When the controller 80 column signal is set to zero volts, op-amp 222 adjusts the final output voltage such that the feedback junction voltage equals the summing junction voltage.

Thus, since the summing junction and feedback junction resistors have the same ratios (note resistor 233 and 236 in the summing junction and resistor 238 and 242 in the feedback loops), the output voltage will go to $V_{MAX}/3$; where $V_{MAX}=V_{TRANS}$.

Thus, when the controller column signal on line 228 from controller 80 is set high (approximately 4.5 volts DC), the op amp circuit amplifies it by a gain of 14 and thus attempts to set the output voltage to approximately 63 volts. Since the $V_{TRANS}$ voltage from the voltage multiplier never goes above 60 volts, the output is saturated at its maximum value $V_{MAX}$ whether this value is $V_{TRANS}$ or $V_{BRIGHT}$. However, in the present embodiment as discussed above, the $V_{MAX}$ voltage should be the $V_{TRANS}$ voltage or 36 volts and the $V_{TRANS}/3$ voltage will be 12 volts.

The corresponding structures, materials, acts, and equivalents of all means or step plus function elements in the claims below are intended to include any structure, material, or act for performing the function in combination with other claimed elements as specifically claimed.

What is claimed is:

1. A method of driving a display having a multiplicity of ChLCD elements addressable by a plurality of rows and a plurality of columns, said multiplicity of ChLCD elements requiring a voltage having an absolute value of $V_{TRANS}$ to switch to the transparent state and a voltage having an absolute value $V_{BRIGHT}$ to switch to the reflective state, said method comprising the steps of:

a) applying a row voltage and a column voltage to each of said multiplicity of elements such that each of said multiplicity of elements is in an "off" state;

b) applying a column voltage $V_{HOLD}$ to said plurality of columns;

c) applying a first voltage to each of said rows of said plurality of rows which includes at least one element of said multiplicity selected to be "on";

d) applying a second voltage to each of the remaining rows of said plurality of rows;

e) applying a column voltage $V_{ON}$ to a first one of said columns of said plurality of columns which includes at least one element of said multiplicity selected to be "on", the column voltage $V_{ON}$ being applied for a selected period of time necessary to change the state of said ChLCD elements; and f) repeating said b) through e) for each column which includes at least one element of said multiplicity selected to be "on".

2. The method of claim 1 wherein said ChLCD elements are in a transparent state when "on" and step a) further comprises the steps of setting the voltage for all of said plurality of rows to "0" volts and setting the voltage for all of said plurality of columns to $V_{BRIGHT}$.

3. The method of claim 1 wherein said ChLCD elements are in a reflective state when "on" and step a) further comprises the steps of setting the voltage for all of said plurality of rows to "0" volts and setting the voltage for all of said plurality of columns to $V_{TRANS}$.

4. The method of claim 1 wherein said ChLCD elements are in a transparent state when "on", said voltage $V_{HOLD}$ equals $V_{TRANS}/3$, said first voltage equals "0" volts, said second voltage equals $2V_{TRANS}/3$, and said column voltage $V_{ON}$ equals $V_{TRANS}$.

5. The method of claim 1 wherein said ChLCD elements are in a reflective state when "on", said voltage $V_{HOLD}$ equals $V_{BRIGHT}$, said first voltage equals "0" volts, said second voltage equals $2V_{TRANS}/3$ and said column voltage $V_{ON}$ equals $V_{BRIGHT}$.

6. The method of claim 1 wherein said ChLCD elements are in a transparent state when "on", said voltage $V_{HOLD}$ equals $V_{TRANS}/3$, said first voltage equals "0" volts, said second voltage equals $2V_{TRANS}/3$, said column voltage $V_{ON}$ equals $V_{TRANS}$, and step a) further comprises the steps of setting the voltage for all of said plurality of rows to "0" volts and setting the voltage for all of said plurality of columns to $V_{BRIGHT}$.

7. The method of claim 1 wherein said ChLCD elements are in a reflective state when "on", said voltage $V_{HOLD}$ equals $V_{BRIGHT}$, said first voltage equals "0" volts, said second voltage equals $2V_{BRIGHT}/3$, said column voltage $V_{ON}$ equals $V_{BRIGHT}$, and step a) further comprises the steps of setting the voltage for all of said plurality of rows to "0" volts and setting the voltage for all of said plurality of columns to $V_{TRANS}$.

8. A multifunctional display comprising:

an array of ChLCD elements arranged in a plurality of rows and a plurality of columns, said array of ChLCD elements requiring a voltage having an absolute value of $V_{TRANS}$ to switch to the transparent state and a voltage having an absolute value of $V_{BRIGHT}$ to switch to the reflective state, $V_{BRIGHT}$ being a higher voltage than $V_{TRANS}$;

a power source for providing a source of power having a voltage $V_{IN}$;

a controller for receiving input commands and for providing output control signals and data at least partially in response to said input commands;

a voltage multiplier circuit for receiving said voltage $V_{IN}$ as an input voltage and for providing output voltage $V_{MAX}$, $V_{MAX}/3$, and $2V_{MAX}/3$;

row driver circuitry for receiving at least one of said output voltages from said voltage multiplier and for selecting applying said received voltage to said plurality of rows of said array in response to a control signal from said controller; and a plurality of column drive circuits, each said column drive circuit receiving at least said voltages $V_{MAX}$ and $V_{MAX}/3$ and selectively applying one of said voltages $V_{MAX}$ and $V_{MAX}/3$ to at least one of said plurality of columns of said array in response to a control signal from said controller.

9. The multifunctional display of claim 8 wherein said output voltage $V_{MAX}$, is selected to be one of $V_{TRANS}$ or $V_{BRIGHT}$ in response to a control signal from said controller.

10. The multifunctional display of claim 8 wherein said row driver circuit receives $2V_{MAX}/3$, and said $V_{MAX}$ voltage is selected to be $V_{TRANS}$ so that "0" volts and $2V_{TRANS}/3$ are available to be selectively applied to said plurality of rows of said array.

11. The multifunctional display of claim 9 wherein said voltage $V_{MAX}$ is selected to be $V_{TRANS}$ such that said plurality of column drivers selectively apply one of said voltages $V_{TRANS}/3$ and $V_{TRANS}$ to a column of said plurality of columns of said array.

12. The multifunctional display of claim 8 wherein said $V_{IN}$ provided by said power source is approximately 5 volts DC.

13. The multifunctional display of claim 8 wherein said voltage multiplier further comprises a Capacitive Voltage Divider circuit for dividing the $V_{MAX}$ voltage so as to generate said $V_{MAX}/3$ and said $2V_{MAX}/3$ voltages.

14. The multifunctional display of claim 8 wherein said voltage multiplier further comprises a sensing circuit connected to said controller for providing and indication of said $V_{MAX}$ voltage to said controller.

15. The multifunctional display of claim 8 wherein said array of ChLCD elements comprises eight (8) rows and four (4) columns, and said plurality of column driver circuits comprises four (4) column driver circuits.

16. The multifunctional display of claim 8 wherein $V_{BRIGHT}$ equals approximately 60 volts and $V_{TRANS}$ equals approximately 36 volts.

17. The multifunctional display of claim 8 wherein said controller further comprises a memory unit for storing a sequence of steps for changing the condition of said elements in said array.

18. The multifunctional display of claim 8 wherein said array is arranged to display a seven (7) element alphanumeric character.

19. The multifunctional display of claim 8 wherein said array is arranged to display at least four (4) separate element numbers, selectable between 0 through 9.

20. The multifunctional display of claim 8 wherein said display includes a background, and one or more portions of said background comprise addressable elements of said display.

* * * * *